US005459028A

United States Patent [19]

Ball

[11] Patent Number: 5,459,028

[45] Date of Patent: Oct. 17, 1995

[54] PHOTOGRAPHIC MATERIAL DEVELOPABLE BY HEAT TREATMENT

[75] Inventor: Walter Ball, Heppenheim, Germany

[73] Assignee: E. I. Du Pont de Nemours and Company, Wilmington, Del.

[21] Appl. No.: 273,580

[22] Filed: Jul. 11, 1994

Related U.S. Application Data

[63] Continuation of Ser. No. 977,861, Nov. 17, 1992, abandoned.

[30] Foreign Application Priority Data

Feb. 22, 1992 [DE] Germany ..... 42 05 450.8

[51] Int. Cl.[6] ..... G03L 1/498

[52] U.S. Cl. ..... 430/619; 430/203; 430/523; 430/600; 430/603; 430/604; 430/607; 430/611; 430/613; 430/570

[58] Field of Search ..... 430/619, 600, 430/603, 611, 613, 607, 604, 570, 605, 620, 629, 203, 523

[56] References Cited

U.S. PATENT DOCUMENTS

| | | | |
|---|---|---|---|
| 4,069,048 | 1/1978 | Tsubota et al. | 430/214 |
| 4,082,723 | 4/1978 | Mayer et al. | 524/83 |
| 4,082,723 | 4/1978 | Mayer et al. | 524/83 |
| 4,142,047 | 2/1979 | Mayer et al. | 544/250 |
| 4,752,559 | 6/1988 | Helland et al. | 430/619 |

FOREIGN PATENT DOCUMENTS

| | | | |
|---|---|---|---|
| 0277817 | 3/1988 | European Pat. Off. . | |
| 63-244036 | 10/1988 | Japan | G03C 7/42 |
| 63-266452 | 11/1988 | Japan | G03C 7/34 |
| 1354186 | 9/1971 | United Kingdom . | |
| 2022276 | 5/1979 | United Kingdom . | |

OTHER PUBLICATIONS

Lettau, Herbert, Some Additional Physical–Chemical Properties of the Hetarenes, *Chemie Der Heterocyclen,* 80–81, 1980.

Chemical Abstracts, The Study of Photographic Activity of Azaadamantane, *Chemical Abstracts,* 113:68189a, 602, 1990.

Van Allan et al., Photothermographic Element, Composition and Process, *Research Disclosure,* No. 14724, 22–24, Jul. 1976.

Houle, Conrad G., Antifoggants in Heat Developable Photographic Materials, *Research Disclosure,* No. 17039, 41–43, Jun. 1973.

Carpenter et al., Photothermographic Silver Halide Systems, *Research Disclosure,* No. 17029, 9–15, Jun. 1978.

Lauf, Paul W., Photothermographic Silver Halide Systems, *Research Disclosure,* No. 29963, 208–214, Mar. 1989.

*Primary Examiner*—Thorl Chea

[57] ABSTRACT

Heat-developable photographic recording materials comprising (a) at least one binder layer coated on a support, the binder layer containing at least one light-sensitive silver halide and a light-insensitive silver salt of a fatty acid; and in the binder layer or in another layer in reactive relationship to the binder layer (b) at least one reducing agent and (c) a stabilizer selected from the group of hexamethylene tetramine and salts thereof, triazaadamantane and salts thereof, and compounds that can be derived from hexamethylene tetramine by exchanging one or more —$CH_2$— groups with —S—, —SO—, or —$SO_2$— provide excellent stability during storage and can be manufactured easily and inexpensively and which presents minimal environmental or health risks.

7 Claims, No Drawings

PHOTOGRAPHIC MATERIAL DEVELOPABLE BY HEAT TREATMENT

This is a continuation of application Ser. No. 07/977,861 filed Nov. 17, 1992, now abandoned.

FIELD OF THE INVENTION

The invention involves a photographic material in which the exposed image can be developed by a heat treatment. Materials of this type usually contain in the photographic emulsion a light-insensitive silver salt, small quantities of a light-sensitive silver halide, and a reducing agent. These materials are also known as "photothermographic materials" or "dry silver materials".

BACKGROUND OF THE INVENTION

Image formation in dry silver emulsions is based on the fact that the latent image generated by exposing the silver halide catalyzes the reaction of the insensitive silver salt with the reducing agent on heat treatment. However, as the reaction participant is not removed from the emulsion after development, progressive silver formation darkens the unexposed areas on extended storage, particularly in daylight. Image contrast decreases, and the image gradually disappears.

Numerous dry silver materials are known in which the developed image is supposed to be stabilized by adding to the light-sensitive emulsion certain compounds known as stabilizers. A number of pertinent publications are cited in Research Disclosure No. 17029, Section VIII (June 1978) and No. 29963, Section XIX (March 1989).

Known stabilizers can be classified almost entirely in the following groups of compounds:

Salts of mercury and other heavy metals
Halogen compounds
Heterocycles, substituted mostly with mercapto groups
Acyclic sulfur compounds
Acids and their derivatives
Compounds that release bases Various disadvantages accompany the use of these stabilizers. Salts of heavy metals and polyhalogenated compounds are no longer considered for consumer materials because of environmental damage. Sulfur compounds often impair sensitivity and maximum density or produce an opaque or yellow-tinted image background. Acids and heterocyclic compounds similarly impair maximum density; also, the latter can often be made only by complex syntheses and are therefore expensive. Many known stabilizers form noxious and unhealthy vapors during the heat treatment.

The problem in the invention involves making a dry silver material that can be manufactured easily and inexpensively with good stability in the developed image and the use of which does not generate an environmental or health risk.

SUMMARY OF THE INVENTION

The above-mentioned problem is solved by a heat-developable photographic recording material with at least one binder layer coated on a support, the binder layer containing at least one light-sensitive silver halide, a light-insensitive silver salt of an organic acid, and in this binder layer or in another layer located in a reactive relationship with the binder layer, at least one reducing agent and a compound that stabilizes the developed image, characterized in that the compound stabilizing the developed image belongs to the group comprising hexamethylene tetramine and its salts, triazaadamantane and its salts, and compounds that can be derived from hexamethylene tetramine by exchanging one or more —$CH_2$— groups for one of —S—, —SO—, or —$SO_2$— groups.

Hexamethylene tetramine, pentamethylene tetramine sulfone, or triazaadamantane are particularly suitable stabilizers.

Preferred salts of these compounds are salts of organic acids, for example, of behenic acid, p-toluene sulfonic acid, or bromoacetic acid.

DETAILED DESCRIPTION OF THE INVENTION

The dry silver materials of the invention comprise at least a light-sensitive coating on a support. This light-sensitive coating contains at least a binder, a light-insensitive silver salt of an organic acid, a reducing agent for this silver salt, and a silver halide.

The binder can be natural and synthetic polymers, such as cellulose acetate; polyvinyl acetals; polyolefins; polymeric esters, for example, of terephthalic acid; polyamides; poly-(n-vinyl)amides; polyvinyl/vinylidene chloride; polystyrene; polyacrylonitrile; polycarbonates; and the like, as well as copolymers of monomers forming the cited polymers.

The light-insensitive silver salt is preferably a salt of a straight-chain fatty acid with 12 to 22 carbon atoms, for example, lauric, myristic, palmitic, stearic, arachic or behenic acid, or a mixture of such salts. Silver stearate is especially preferred.

Reducing agents can be aromatic dihydroxy compounds, such as hydroquinone, catechol or their precursors. Also suitable are other compounds that act as photographic developers, such as meta- or para-aminophenols, 3-pyrazolidinones, ascorbic acid, and their derivatives. Bisphenols, for example, bis(2 -hydroxy-3-t-butyl-6-methylphenyl-)methane, are preferred. The reducing agent can be in the light-sensitive emulsion or in a contiguous auxiliary layer. Its quantity is usually 0.1 to 3 equivalents, relative to the total weight of reducible silver salts.

The light-sensitive silver halide can be prepared in situ from the light-insensitive silver salt by reaction with a limited amount of a compound that releases halide ions. Such compounds are, for example, alkali metal halides, ammonium halides, or organic N-halogen compounds, such as N-bromosuccinimide, N-bromophthalimide, N-chlorophthalazinone, N-bromoacetamide, and others. Other methods of this type are described in publications cited in Research Disclosure No. 17029, Section I (June 1978) and No. 29963, Section XV (March 1989).

The silver halide is prepared preferably in a separate step ("ex situ") in an aqueous solution containing a hydrophilic colloid, preferably gelatin. Procedures for precipitation and chemical and spectral sensitization in the conventional technology for photographic silver halide emulsions are used here. Thereafter, the silver halide can be separated from the protective colloid, for example by the procedure in Goffe, U.K. Patent 13 54 186. The isolated and optionally sensitized silver halide is then added to the coating composition for the light-sensitive layer of the dry silver material. The preferred silver halides are silver bromide and silver bromoiodide with an iodide proportion up to 10 mole percent. The silver halide grain size is preferably between 0.05 and 0.5 micron. The silver halide proportion to total silver salt content in the light-sensitive layer is generally less than 10, preferably 0.2 to 2, mole percent.

It is advantageous to add to the invention's dry silver materials a so-called toner, so that the developed silver image attains a neutral black color and high density. Known toners are described in Research Disclosure No. 17029 (June 1978) Section V and 29963 (March 1989) Section XXII. Examples of useful toners are phthalazinone and its derivatives, for example, 2 -acetylphthalazinone, phthalimide and its derivatives, such as N-hydroxyphthalimide, succinimide, and N-hydroxy-1,8-naphthalimide.

In addition to the light-sensitive layer, the dry silver materials can have other layers, for example, auxiliary layers, such as protective layers or adhesion-promoting layers, over or under the light-sensitive layer, or antihalation or anticurl layers coated on the back side of the support. In this case, it is preferable to put the invention's stabilizer in an auxiliary layer located in a reactive relationship to the light-sensitive layer, that is, so that the stabilizer can diffuse back and forth between this layer and the light-sensitive layer. A protective layer placed over the light-sensitive layer is particularly preferred for this purpose.

Supports can be clear as well as dyed or pigmented synthetic resin sheets, for example, of polyethylene terephthalate or cellulose acetate, and uncoated or coated papers.

Industrial Applicability

The invention's dry silver materials are outstanding for good stability, even when stored unused, especially from the standpoint of fog and maximum density.

Use of the invention's dry silver materials can avoid risks, for example, harmful gases, to the health of persons concerned with processing.

The stabilizers used in the invention, particularly hexamethylene tetramine, are relatively easy to make or obtainable commercially at a relatively low price.

The invention's materials can be used for making images by exposure and heat development, particularly for contact copies, projection enlargements, and camera copies for reprography.

EXAMPLES 1

A light-sensitive coating composition for dry silver material was prepared by milling the following components for 18 hr in a bead mill with cooling and with 1,000 mL of glass beads (2 mm diameter):

| | |
|---|---|
| 196 g | silver stearate |
| 1,500 mL | ethanol |
| 40 g | polyvinyl pyrrolidone K30 (molecular weight 40,000) |
| 4 mL | nonylphenol ethoxylate (10 EO) |
| 7 g | behenic acid |

To check the degree of milling, a sample of the dispersion was examined at 100× enlargement under a microscope until no particles were recognizable. This coating solution is designated as A.

The following were added to this dispersion with stirring:

| | |
|---|---|
| 60 g | polyvinyl pyrrolidone |
| 1.28 g | mercury (II) chloride in 200 mL ethanol |
| 16 g | phthalazinone in 200 mL ethanol, and |
| 6.4 g | 5-nitroindazole in 250 mL ethanol. |

This coating solution B is ready for use after the glass beads are removed.

The following components:

| | |
|---|---|
| 4 mL | nonylphenol ethoxylate (10 EO) |
| 40 g | polyvinylbutyral (molecular weight 36,000) , |
| 34 g | 3,3'-di-t-butyl-2,2'-dihydroxy-5,5'-dimethyl diphenylmethane |
| 0.086 | mole of compound (shown in Table 1) to stabilize the developed image |

were dissolved in a solvent mixture of 400 mL dichloromethane and 80 mL 2-propanol to form coating solution C.

Coating solution B was coated on a polyethylene terephthalate support at a 60 μm coating thickness and dried. Coating solution C was coated on the dry layer at a 100 μm coating thickness and the composite was dried again.

Thus were obtained dry silver films that differed only in the type of stabilizer contained in the protective coating. Samples of these films were exposed imagewise in a contact exposure device through a mask and developed by placement for 20 sec on a metal surface at 105° C.

The developed film samples were placed for several days next to each other near a window and thus exposed to ambient daylight. The optical minimum density (in the image-free areas) was measured daily with a densitometer. Minimum density as a function of daylight exposure time is shown in Table 1. The density of the support was 0.02.

TABLE 1

| | | Exposure Time in Days | | | | |
|---|---|---|---|---|---|---|
| Sample | Stabilizer | 1 | 2 | 5 | 8 | 12 |
| 1 | None | 0.05 | 0.07 | 0.22 | 0.32 | 0.40 |
| 2 | Imidazole | 0.06 | 0.11 | 0.19 | 0.28 | 0.35 |
| 3 | Tetrachlorophthalic anhydride | 0.05 | 0.10 | 0.14 | 0.20 | 0.25 |
| 4 | Tetrabromophthalic anhydride | 0.05 | 0.09 | 0.16 | 0.23 | 0.32 |
| 5 | Hexamethylene tetramine | 0.07 | 0.07 | 0.09 | 0.11 | 0.12 |

The results show that Sample 5 in accordance with the invention is substantially more stable to daylight after processing than the comparison samples.

EXAMPLE 2

A silver bromoiodide emulsion with a 0.15 μm grain size and 2 mole percent iodide content was prepared by pAg-controlled double jet precipitation in the presence of gelatin, and separated from soluble salts in the usual manner. The emulsion was ripened chemically to optimum sensitivity as usual by adding gold and sulfur compounds. 10 g trypsin per mole of silver halide were added and the emulsion was digested 60 min at 40° C. The silver halide was separated in a centrifuge and washed with acetone.

1 g of the resulting silver iodobromide was dispersed in 1450 g of coating solution B of Example 1. The resulting coating solution D was coated on a support as described in Example 1 and coated with an auxiliary layer of coating solution C. The film samples were exposed imagewise in a camera, developed as in Example 1, and tested for stability to daylight. The results are shown in Table 2.

TABLE 2

| Sample | Stabilizer | Exposure Time in Days | | | | |
|---|---|---|---|---|---|---|
| | | 1 | 2 | 6 | 10 | 14 |
| 6 | None | 0.10 | 0.23 | 0.30 | 0.35 | 0.38 |
| 7 | Hexamethylene tetramine | 0.06 | 0.06 | 0.07 | 0.08 | 0.08 |
| 8 | Pentamethylene tetraminesulfone | 0.05 | 0.05 | 0.06 | 0.10 | 0.12 |
| 9 | Tetrachlorophthalic anhydride | 0.08 | 0.14 | 0.22 | 0.25 | 0.29 |

What is claimed is:

1. A heat-developable photographic recording material comprising:

(a) at least one binder layer coated on a support, said binder layer comprising at least one light-sensitive silver halide and a light-insensitive silver salt of a fatty acid;

(b) at least one reducing agent; and (c) at least one auxiliary layer coated on the binder layer, the auxiliary layer containing a developed image stabilizer selected from the group consisting of hexamethylene tetramine and salts thereof, triazaadamantane and salts thereof and compounds derived from hexamethylene tetramine wherein the compounds are derived from hexamethylene tetramine by exchanging one —$CH_2$— group with —S—, —SO—, or —$SO_2$—;

(d) wherein said reducing agent and said developed image stabilizers are in a reactive relationship with the light sensitive silver halide and the light-insensitive silver salt.

2. The recording material of claim 1, wherein the stabilizer is present in an amount between 1 and 100 mmol per mole of light-insensitive silver salt.

3. The recording material of claim 2, wherein the stabilizer is present in an amount between 2 and 30 mmol per mole of light-insensitive silver salt.

4. The recording material of claim 3, wherein the stabilizer is present in an amount between 5 and 15 mmol per mole of light-insensitive silver salt.

5. The recording material of claim 1, wherein the stabilizer is present in the binder layer.

6. The recording material of claim 1, wherein the silver halide comprises a silver halide formed ex situ which has been chemically sensitized.

7. The recording material of claim 6, wherein the silver halide is spectrally sensitized.

* * * * *